US009551093B2

(12) United States Patent
Hsu

(10) Patent No.: US 9,551,093 B2
(45) Date of Patent: Jan. 24, 2017

(54) DOWN-PROOF DOUBLE-LAYER FABRIC

(71) Applicant: HOP PIN ENTERPRISE CO., LTD, Taipei (TW)

(72) Inventor: Tung-Jung Hsu, Taipei (TW)

(73) Assignee: HOP PIN ENTERPRISE CO., LTD, Taipei (TW)

( * ) Notice: Subject to any disclaimer, the term of this patent is extended or adjusted under 35 U.S.C. 154(b) by 0 days.

(21) Appl. No.: 14/803,680

(22) Filed: Jul. 20, 2015

(65) Prior Publication Data

US 2016/0333504 A1 Nov. 17, 2016

(30) Foreign Application Priority Data

May 13, 2015 (TW) ..... 104115280 A

(51) Int. Cl.

| | |
|---|---|
| ***D03D 15/00*** | (2006.01) |
| ***D03D 1/00*** | (2006.01) |
| ***D03D 11/02*** | (2006.01) |
| ***D03D 15/08*** | (2006.01) |

(52) U.S. Cl.

CPC ..... *D03D 11/02* (2013.01); *D03D 1/0017* (2013.01); *D03D 15/08* (2013.01)

(58) Field of Classification Search

CPC ..... D03D 13/008; D03D 15/00; D03D 1/00; D03D 13/004; D03D 1/0041; A41D 31/02

See application file for complete search history.

(56) References Cited

U.S. PATENT DOCUMENTS

| | | | | | |
|---|---|---|---|---|---|
| 2,042,442 | A | * | 5/1936 | Buchman | A41D 23/00 2/91 |
| 2,959,793 | A | * | 11/1960 | Bell | A41G 9/00 428/172 |
| 3,772,137 | A | * | 11/1973 | Tolliver | A47C 27/12 425/382.2 |
| 4,477,515 | A | * | 10/1984 | Masuda | D04H 1/54 428/359 |
| 4,619,864 | A | * | 10/1986 | Hendrix | D06B 1/142 427/387 |
| 4,930,173 | A | * | 6/1990 | Woller | A47C 27/144 297/452.48 |
| 5,256,236 | A | * | 10/1993 | Woller | A47C 27/144 156/221 |
| 5,513,400 | A | * | 5/1996 | Turner | A47C 21/048 5/422 |

(Continued)

*Primary Examiner* — Bobby Muromoto, Jr.

(74) *Attorney, Agent, or Firm* — Muncy, Geissler, Olds & Lowe, P.C.

(57) ABSTRACT

A first fabric layer of a down-proof double-layer fabric has a plurality of first warps and a plurality of first wefts. A second fabric layer has a plurality of second warps and a plurality of second wefts. The first fabric layer and the second fabric layer have a plurality of coupling portions. In the coupling portions, the first fabric layer and the second fabric layer pass through each other repeatedly, and the first warps and the second warps are interlaced. The first warps, the first wefts, the second warps, and the second wefts are between 20 denier and 75 denier. The warp densities of the first fabric layer and the second fabric layer are between 336 pieces/in and 456 pieces/in, and the weft densities of the first fabric layer and the second fabric layer are between 220 pieces/inch$^2$ and 300 pieces/in.

9 Claims, 3 Drawing Sheets

(56) References Cited

U.S. PATENT DOCUMENTS 5,850,646 A * 12/1998 Turner ..... A47C 21/048 5/665
6,038,701 A * 3/2000 Regan ..... A41D 13/0512 2/115
6,141,800 A * 11/2000 Regan ..... A41D 13/0512 2/115
6,589,891 B1 * 7/2003 Rast ..... A41D 13/0158 2/455
6,824,819 B2 * 11/2004 Vogt ..... D06M 11/83 427/203
7,682,693 B2 * 3/2010 Molina ..... B68G 1/00 428/359
8,220,499 B2 * 7/2012 Fukunishi ..... D03D 1/00 139/420 A
8,769,743 B2 * 7/2014 Sanders ..... A47C 27/007 5/500
9,392,825 B2 * 7/2016 Pezzimenti ..... A41D 27/28
2003/0027476 A1 * 2/2003 Vogt ..... D06M 11/83 442/380
2004/0019950 A1 * 2/2004 Rast ..... A41D 13/0158 2/77
2006/0183390 A1 * 8/2006 Fukunishi ..... D03D 1/00 442/181
2008/0193690 A1 * 8/2008 Molina ..... B68G 1/00 428/36.4
2009/0089911 A1 * 4/2009 Smith ..... A41D 3/04 2/69
2011/0033687 A1 * 2/2011 Deguchi ..... D03D 1/0041 428/219
2011/0185500 A1 * 8/2011 Sanders ..... A47C 27/007 5/502
2012/0183754 A1 * 7/2012 Kitagawa ..... D03D 13/008 428/212
2013/0035014 A1 * 2/2013 Tone ..... D03D 13/008 442/189
2013/0263386 A1 * 10/2013 Romero ..... A47G 9/00 8/137
2013/0276201 A1 * 10/2013 Pezzimenti ..... A41D 13/002 2/69
2013/0340916 A1 * 12/2013 Smith ..... A41D 3/04 156/60
2014/0304906 A1 * 10/2014 Bennett ..... E02D 3/00 4/506
2015/0201683 A1 * 7/2015 Maud ..... A41D 13/002 428/72
2015/0203997 A1 * 7/2015 Yamanaka ..... D03D 15/0083 2/97
2016/0160436 A1 * 6/2016 Lyons ..... B08B 17/065 442/62
2016/0235147 A1 * 8/2016 Pezzimenti ..... A41D 13/002

* cited by examiner

DOWN-PROOF DOUBLE-LAYER FABRIC

CROSS REFERENCE TO RELATED APPLICATIONS

This Non-provisional application claims priority under 35 U.S.C. §119(a) on Patent Application No(s). 104115280 filed in Taiwan, Republic of China on May 13, 2015, the entire contents of which are hereby incorporated by reference.

BACKGROUND OF THE INVENTION

Field of Invention

The invention relates to a down-proof double-layer fabric and, in particular, to a down-proof double-layer fabric which utilizes the structure of the fabric itself for down-proof.

Related Art

Recently, with the advance of technology and the improvement of life quality, people's requirements for daily necessities are accordingly raised, and they put more emphasis on the functions of clothing for warmth, comfort, and health. Because down is comfortable and warm, fabrics are often filled with down and made into, for example, clothing (coat) or quilts, etc.

The so-called down-proof fabric refers to the fabric which prevents down filler from exudation. For the down-proof fabric, conventional technology generally utilizes coating, lamination, high density fabric by calendaring (the fabric is treated by high temperature and pressure with metal cylindrical sticks) to prevent the down filler from exudation from the fabric so as to be down-proof. Furthermore, to distribute the down filler evenly between the fabric layers and to avoid the down filler excessively accumulating in some parts, compartments are generally made by machine sewing in conventional technology so that the down filler located in the compartments is restricted in the compartments, and the down filler dose not accumulate in some parts of the fabric after using.

Although conventional technology can utilize coating, lamination, or calendaring to achieve down-proof for the fabric and the compartments are made by machine sewing, these external processing technologies are quite work-consuming, time-consuming, energy-consuming and environmentally unfriendly. Therefore, it is an important subject to provide a down-proof double-layer fabric which utilizes the structure of the fabric itself for down-proof by construction (for example without coating, lamination, or calendaring) and has the advantages of energy saving, environmental protection, and reduction in carbon emissions.

SUMMARY OF THE INVENTION

An objective of the invention is to provide a down-proof double-layer fabric which utilizes the structure of the fabric itself for down-proof by construction and reduces the leakage of down caused by machine sewing. Moreover, in addition to the down-proof, the invention can further reduce lots of manufacturing processes and have the advantages of energy saving, environmental protection, and reduction in carbon emissions in comparison with conventional down-proof technology.

To achieve the above objective, a down-proof double-layer fabric according to the invention includes a first fabric layer and a second fabric layer. The first fabric layer has a plurality of first warps and a plurality of first wefts. The second fabric layer has a plurality of second warps and a plurality of second wefts. The first fabric layer and the second fabric layer have a plurality of coupling portions. In the coupling portions, the first fabric layer and the second fabric layer pass through each other repeatedly, and the first warps and the second warps are interlaced. The first warps, the first wefts, the second warps, and the second wefts are between 20 denier and 75 denier. The warp densities of the first fabric layer and the second fabric layer are between 336 pieces/in and 456 pieces/in, and the weft densities of the first fabric layer and the second fabric layer are between 220 pieces/in and 300 pieces/in.

To achieve the above objective, a down-proof double-layer fabric according to the invention includes a first fabric layer and a second fabric layer. The first fabric layer has a plurality of first warps and a plurality of first wefts. The second fabric layer has a plurality of second warps and a plurality of second wefts. The first fabric layer and the second fabric layer have a plurality of coupling portions. In the coupling portions, the first fabric layer and the second fabric layer pass through each other repeatedly and the first wefts and the second wefts are interlaced. The first warps, the first wefts, the second warps, and the second wefts are between 20 denier and 75 denier. The warp densities of the first fabric layer and the second fabric layer are between 336 pieces/in and 456 pieces/in, and the weft densities of the first fabric layer and the second fabric layer are between 220 pieces/in and 300 pieces/in.

To achieve the above objective, a down-proof double-layer fabric according to the invention includes a first fabric layer and a second fabric layer. The first fabric layer has a plurality of first warps and a plurality of first wefts. The second fabric layer has a plurality of second warps and a plurality of second wefts. The first warps, the first wefts, the second warps, and the second wefts are between 20 denier and 75 denier. The warp density of the down-proof double-layer fabric is between 336 pieces/in and 456 pieces/in, and the weft densities of the first fabric layer and the second fabric layer are between 220 pieces/in and 300 pieces/in.

In one embodiment, the first warps, the first wefts, the second warps, and the second wefts are between 30 denier and 50 denier.

In one embodiment, the materials of the first warps, the first wefts, the second warps, and the second wefts are polyester fibers, nylon fibers, cationic dyeable fibers, or cotton fibers In one embodiment, the material of the first warps differs from that of the second warps.

In one embodiment, the first warps, the first wefts, the second warps, and the second wefts are elastic yarn.

In one embodiment, the first warps and the second warps have different colors.

In one embodiment, the first fabric layer and the second fabric layer form a receiving space between two adjacent coupling portions.

In one embodiment, the down-proof double-layer fabric is further treated by surface calendaring at a temperature, and the temperature is between 50° C. and 70° C.

As mentioned above, as to the down-proof double-layer fabric of the invention, in the coupling portions, the first fabric layer and the second fabric layer pass through each other repeatedly, the first warps and the second warps or the first wefts and the second wefts are interlaced, so the down-proof double-layer fabric can utilize the structure of the coupling portion of the fabric itself for down-proof by construction (for example without coating, lamination, or calendaring). Moreover, as to the down-proof double-layer fabric according to the invention, the first warps, the first wefts, the second warps, and the second wefts are between 20 denier and 75 denier, the warp densities of the first fabric layer and the second fabric layer are between 336 pieces/in and 456 pieces/in, and the weft densities of the first fabric layer and the second fabric layer are between 220 pieces/in and 300 pieces/in. Accordingly, compared with conventional down-proof by machine sewing, the invention may also reduce the leakage of down caused by machine sewing. Further, in addition to the down-proof, the down-proof double-layer fabric according to the invention may further reduce lots of manufacturing processes and have the advantages of energy saving, environmental protection, and reduction in carbon emissions in comparison with conventional down-proof technology.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
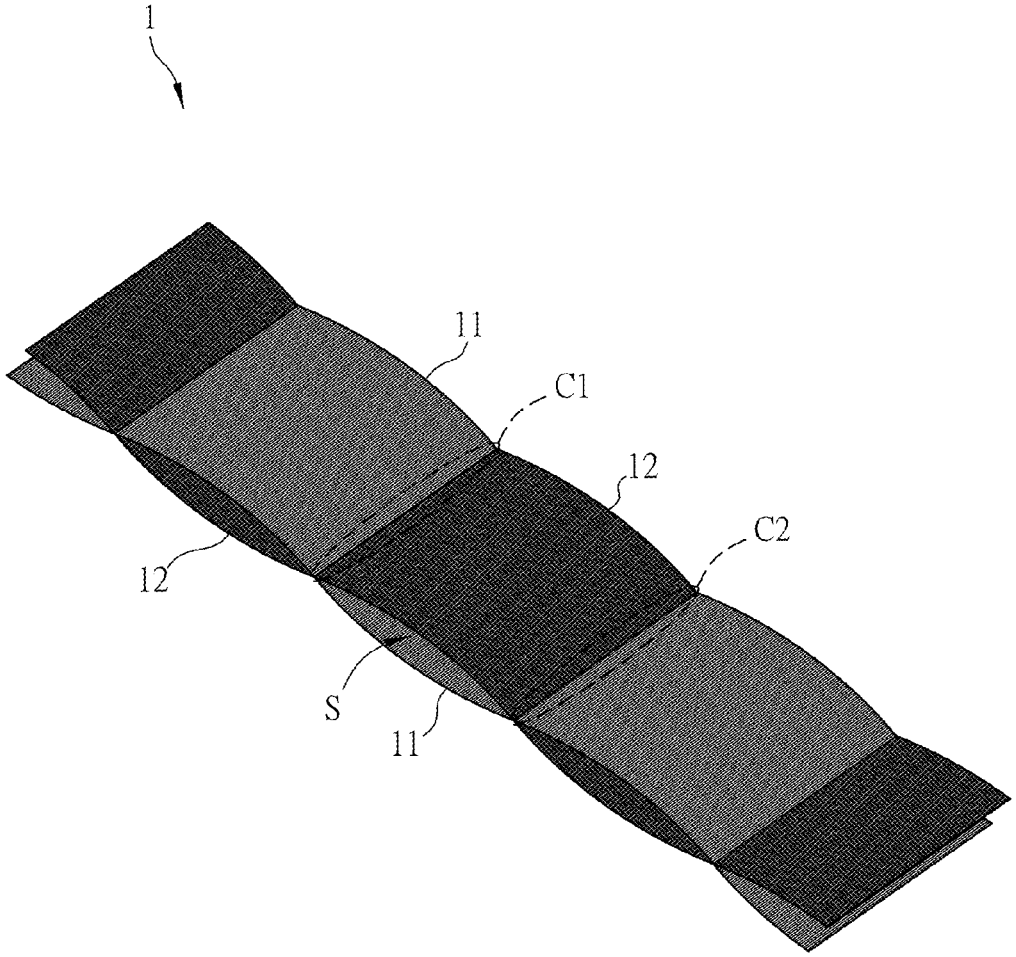
FIG. 1 is a schematic diagram of a down-proof double-layer fabric according to a preferred embodiment of the invention.
Figure 2:
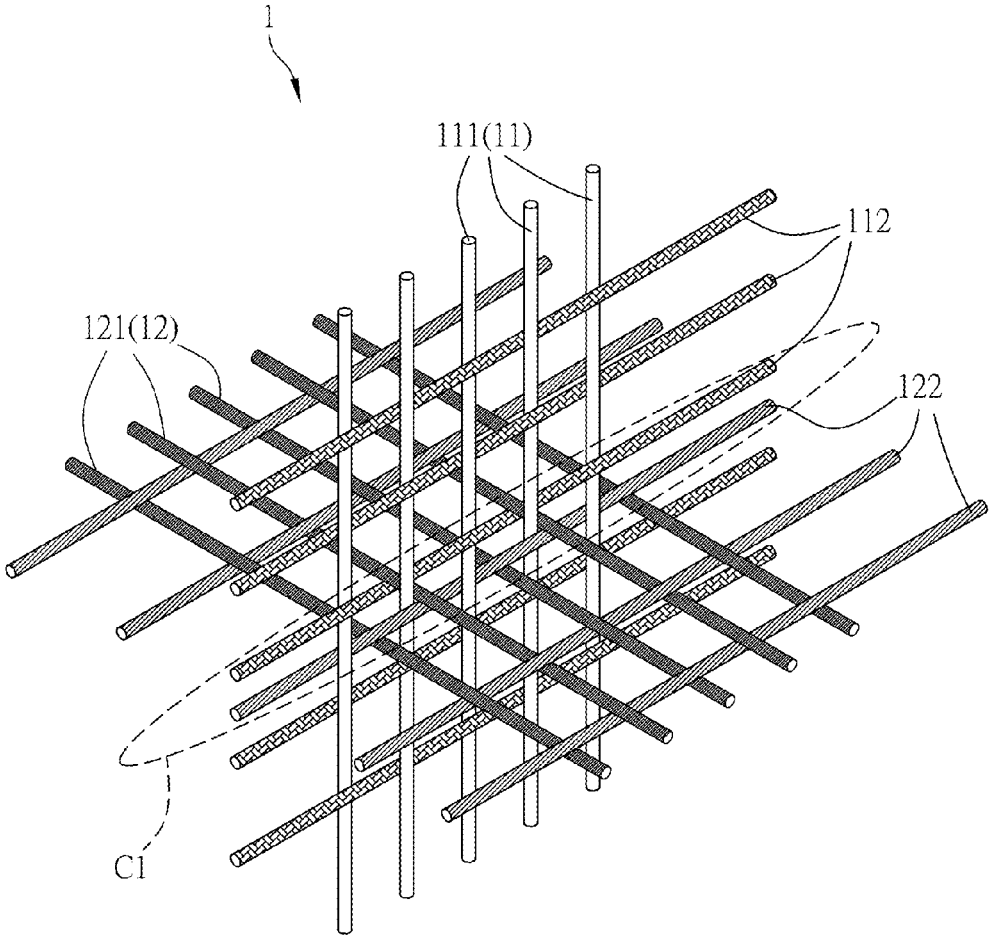
FIGS. 2 and 3 are respectively enlarged schematic diagrams of the down-proof double-layer fabric in FIG. 1.
Figure 3:
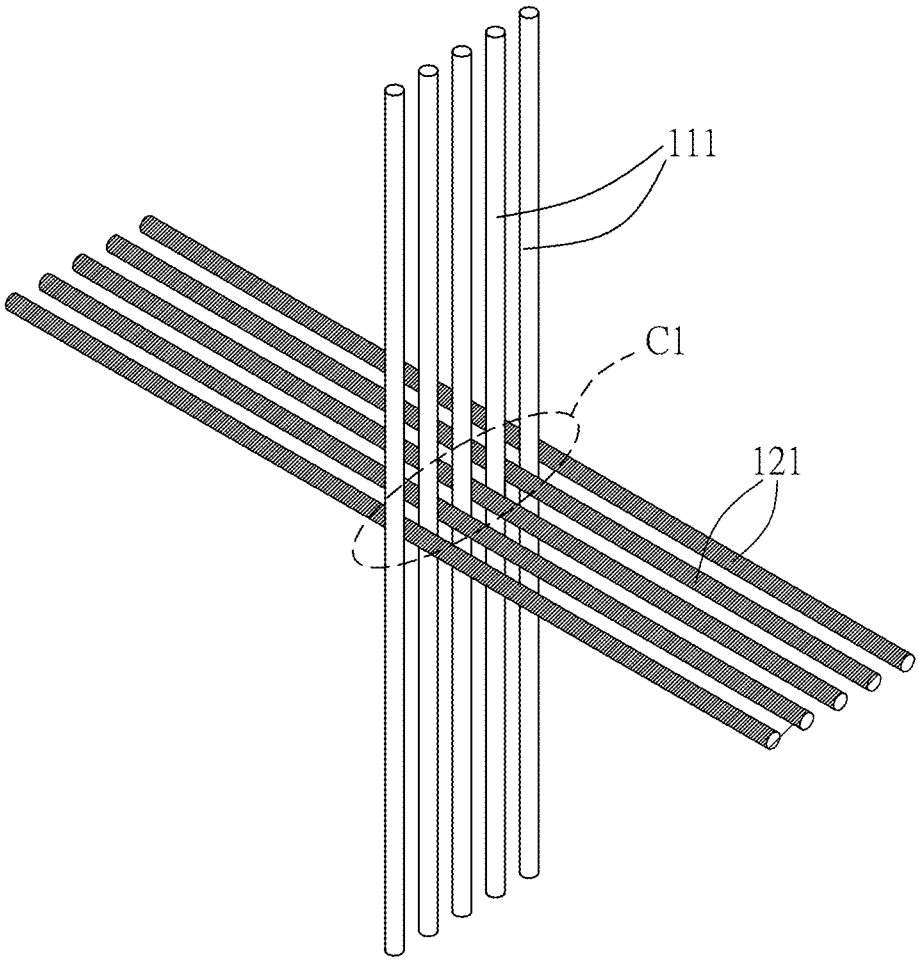

Referring to FIGS. 1 to 3, FIG. 1 is a schematic diagram of a down-proof double-layer fabric 1 according to a preferred embodiment of the invention, and FIGS. 2 and 3 are respectively enlarged schematic diagrams of the down-proof double-layer fabric 1 in FIG. 1. The thicknesses of the warp and the weft and the intervals between each yarn illustrated in the figures are not illustrated according to the actual proportion. A person having ordinary skill in the art should learn the arrangement and the interlaced manner of each warp and weft of the embodiment from FIGS. 2 and 3 and then understand the coupling manner of each fabric layer of the down-proof double-layer fabric 1 of the embodiment at each coupling portion (details are as follows). However, to avoid the figure being overly complex, the first wefts 112 and the second wefts 122 in FIG. 2 are not shown in FIG. 3. The down-proof double-layer fabric 1 of the embodiment is a textile object which can prevent, for example but not limited to, the down filler from exudation can be processed and used in clothing or cotton objects for comfort and warmth.

As shown in FIG. 1, the down-proof double-layer fabric 1 includes a first fabric layer 11 and a second fabric layer 12. The first fabric layer 11 and the second fabric layer 12 pass through each other repeatedly, and the first fabric layer 11 and the second fabric layer 12 have a plurality of coupling portions. The coupling portions are C1 and C2 in FIG. 1 for example. In other words, the first fabric layer 11 and the second fabric layer 12 pass through each other repeatedly, and where they pass through each other may form a plurality of coupling portions C1, C2 . . . , etc. Here, "pass through each other repeatedly" refers to, for example, the first fabric layer 11 is located above the second fabric layer 12 on the left side of the coupling portion C1, the second fabric layer 12 is located above the first fabric layer 11 on the right side of the coupling portion C1 (or on the left side of the coupling portion C2), the first fabric layer 11 is located above the second fabric layer 12 again on the right side of the coupling portion C2, and so on. In details, the first fabric layer 11 and the second fabric layer 12 are mutually interlaced and have a plurality of interlaced places, and each interlaced place forms a coupling portion. Moreover, the first fabric layer 11 and the second fabric layer 12 may form a receiving space S between two adjacent coupling portions (e.g. C1 and C2), and the receiving space S may be filled with down. After filled with down and then cut into the cutting piece according to the use (e.g. down jacket, duvet, sleeping bag, or the like), the openings on the other two sides of the receiving space S are connected by machine sewing so as to become a completely enclosed space.

The first fabric layer 11 has a plurality of first warps 111 and a plurality of first wefts 112, and the second fabric layer 12 has a plurality of second warps 121 and a plurality of second wefts 122. In other words, as shown in FIG. 2, the first warps 111 and the first wefts 112 are interwoven to form the first fabric layer 11 (one first weft 112 continuously passes through the upper side, lower side, upper side, lower side . . . of the first warps 111), and the second warps 121 and the second wefts 122 are also interwoven to form the second fabric layer 12 (one second weft 122 continuously passes through the upper side, lower side, upper side, lower side . . . of the second warp 121). The warp densities of the first fabric layer 11 and the second fabric layer 12 may be between 366 pieces/in and 456 pieces/in (366 pieces/in≤warp density≤456 pieces/in), and the weft densities of the first fabric layer 11 and the second fabric layer 12 are between 220 pieces/in and 300 pieces/in (220 pieces/in≤weft density≤300 pieces/in). In some embodiments, the weft density may be between 230 pieces/in and 290 pieces/in. In other embodiments, the weft density may be between 230 pieces/in and 280 pieces/in. Moreover, because the first fabric layer 11 and the second fabric layer 12 pass through each other repeatedly to form a plurality of the coupling portions, the warp density and the weft density will be added up and become denser in the coupling portions. It should be noted that the total number of warps (111, 121) on the warp beam may be between 22000 pieces and 26800 pieces in the embodiment.

Furthermore, in the coupling portions, for example the coupling portion C1, the first warps 111 and the second warps 121 are interlaced, and the first warps 111, the first wefts 112, the second warps 121, and the second wefts 122 may be between 20 denier (D) and 75 denier (D) (20 D to 75 D). Here, "interlaced" as shown in FIG. 3 means that, in the coupling portion C1, one second warp 121 is sandwiched between two first warps 111, and one first warp 111 is also sandwiched between two second warps 121. Moreover, "denier (D)" is a unit of measure for the thickness and the weight of yarn, and it is defined as the mass (grams) per 9000 meters of a fiber. For example, the mass of a 20 denier (D) fiber of 9000 meters is 20 grams. In some embodiments, the first warps 111, the first wefts 112, the second warps 121, and the second wefts 122 may be between 30 denier (D) and 50 denier (D) (30 D to 50 D).

The materials of the first warps 111, the first wefts 112, the second warps 121, and the second wefts 122 may be, for example but not limited to, polyester fibers, nylon fibers, cationic dyeable fibers (commonly known as CD yarn), or cotton fibers, and they are not limited thereto. In addition, the first warps 111, the first wefts 112, the second warps 121, and the second wefts 122 may be elastic yarn, so the down-proof double-layer fabric 1 is elastic. Here, the first fabric layer 11 and the second fabric layer 12 may be the same material or different materials, the first warps 111 and the second warps 121 may be the same material or different materials, the first wefts 112 and the second wefts 122 may also be the same material or different materials, and they are not limited thereto.

Moreover, the first warp 111 and the second warp 121 may have different colors, the first weft 112 and the second weft 122 may also have different colors, so that the down-proof double-layer fabric 1 may have various color blocks or areas of various colors and thus double colors or multiple colors appear. It should be also noted that the warps (or wefts) of different materials may be dyed different colors by different dyeing methods. Further, general dyeing methods are classified into "yarn-dyed" and "piece-dyed". "Yarn-dyed" is that yarn is dyed first and then woven into cloth (commonly known as pre-dyed). "Piece-dyed" is that cloth is dyed after woven (commonly known as post-dyed). Dyeing methods are not limited thereto.

As described above, as to the down-proof double-layer fabric 1 of the embodiment, in the coupling portions, the first fabric layer 11 and the second fabric layer 12 pass through each other repeatedly, the first warps 111 and the second warps 121 are interlaced, so the down-proof double-layer fabric 1 may utilize the structure of the fabric itself for down-proof by construction. Moreover, in the down-proof double-layer fabric 1 of the embodiment, the linear densities (the unit thereof is denier) of the first warps 111, the first wefts 112, the second warps 121, and the second wefts 122 are within the range described above, the warp density and the weft density are within the range described above, and the warp density and the weft density are added up in the coupling portions. Accordingly, compared with conventional compartments formed by machine sewing, the down-proof double-layer fabric 1 of the embodiment is woven to directly form a double-layer fabric which has a configuration of compartments as a result of that the first fabric layer 11 and the second fabric layer 12 pass through each other repeatedly and the first warps 111 and the second warps 121 are interlaced. Therefore, the down-proof double-layer fabric 1 of the embodiment may reduce the leakage of down caused by machine sewing in comparison with conventional technology. Moreover, compared with conventional down-proof technology (coating, lamination, and calendaring for example), the down-proof double-layer fabric 1 may reduce lots of manufacturing processes and have the advantages of working-hours saving, energy saving (electricity saving, heat saving, and water saving), environmental protection (reduction in water discharge and heat discharge), and reduction in carbon emissions.

Under the condition of enough warp density and weft density, the down-proof double-layer fabric 1 itself is down-proof (down-proof by construction). To further improve the down-proof capability of the down-proof double-layer fabric 1, in some embodiments, the down-proof double-layer fabric 1 may be further treated by surface calendaring at a temperature (especially when the numbers of or the densities of the warps and the wefts are relatively low), the temperature may be between 50° C. and 70° C., preferably between 63° C. and 69° C., or around 68° C. (around the turn-on temperature of the calendaring machine) for example. It is not necessary to heat to 180° C. to 200° C. like conventional calendaring. Therefore, working-hours saving, energy saving, environmental protection, and reduction in carbon emissions is achieved.

The down-proof double-layer fabric 1 was actually sent to a notarization institution to proceed with two inspections, and the inspection processes and results are as follows. First inspection: the down-proof double-layer fabric 1 is observed after shaken for 45 minutes. No down pierces out the surface of the down-proof double-layer fabric 1, and the surface of the fabric remains ordinary. Second inspection: the down-proof double-layer fabric 1 is observed after shaken for 45 minutes first, washed for 12 minutes with water of 105° F. (40.56° C.) by a washing machine, and then shaken for 45 minutes in a low temperature and dry condition. No down pierces out the surface of the down-proof double-layer fabric 1, and the surface of the fabric still remains ordinary. Thereby, it is proved that the down-proof double-layer fabric 1 of the embodiment can utilize the structure of the fabric itself for down-proof.

Moreover, a down-proof double-layer fabric is also provided. It includes a first fabric layer and a second fabric layer. The first fabric layer has a plurality of first warps and a plurality of first wefts, and the second fabric layer has a plurality of second warps and a plurality of second wefts. The first fabric layer and the second fabric layer have a plurality of coupling portions. In the coupling portions, the first fabric layer and the second fabric layer pass through each other repeatedly, and the first wefts and the second wefts are interlaced. The first warps, the first wefts, the second warps, and the second wefts are between 20 denier (D) and 75 denier (D). The warp densities of the first fabric layer and the second fabric layer are between 366 pieces/in and 456 pieces/in, and the weft densities of the first fabric layer and the second fabric layer are between 220 pieces/in and 300 pieces/in. The technical contents of the first warp and the first weft of this embodiment may respectively correspond to or refer to the first weft 112 and the first warp 111 of the down-proof double-layer fabric 1 described above, the technical contents of the second warp and the second weft of this embodiment may respectively correspond to or refer to the second weft 122 and the second warp 121 of the down-proof double-layer fabric 1 described above, and the technical contents of the first fabric layer and the second fabric layer of this embodiment may respectively correspond to or refer to the first fabric layer 11 and the second fabric layer 12 of the down-proof double-layer fabric 1 described above, so the technical features thereof are not repeated here.

Further, a down-proof double-layer fabric is also provided. It includes a first fabric layer and a second fabric layer. The first fabric layer has a plurality of first warps and a plurality of first wefts, and the second fabric layer has a plurality of second warps and a plurality of second wefts. The first warps, the first wefts, the second warps, and the second wefts are between 20 denier (D) and 75 denier (D). The warp density of the down-proof double-layer fabric is between 366 pieces/in and 456 pieces/in, and the weft densities of the first fabric layer and the second fabric layer are between 220 pieces/in and 300 pieces/in. The technical contents of the first fabric layer, the second fabric layer, the first warp, the first weft, the second warp, and the second weft may respectively correspond to or refer to the first fabric layer 11, the second fabric layer 12, the first warp 111, the first weft 112, the second warp 121, and the second weft 122 of the down-proof double-layer fabric 1 described above, so the technical features thereof are not repeated here.

In summary, as to the down-proof double-layer fabric of the invention, in the coupling portions, the first fabric layer and the second fabric layer pass through each other repeatedly, the first warps and the second warps or the first wefts and the second wefts are interlaced, so the down-proof double-layer fabric can utilize the structure of the coupling portion of the fabric itself for down-proof by construction. Moreover, as to the down-proof double-layer fabric according to the invention, the first warps, the first wefts, the second warps, and the second wefts are between 20 denier and 75 denier, the warp densities of the first fabric layer and the second fabric layer are between 336 pieces/in and 456 pieces/in, and the weft densities of the first fabric layer and the second fabric layer are between 220 pieces/in and 300 pieces/in. Accordingly, compared with conventional down-proof by machine sewing, the invention may also reduce the leakage of down caused by machine sewing. Further, in addition to the down-proof, the down-proof double-layer fabric according to the invention may further reduce lots of manufacturing processes and have the advantages of energy saving, environmental protection, and reduction in carbon emissions in comparison with conventional down-proof technology.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A down-proof double-layer fabric, comprising:

a first fabric layer, having a plurality of first warps and a plurality of first wefts; and a second fabric layer, having a plurality of second warps and a plurality of second wefts;

wherein the first fabric layer and the second fabric layer have a plurality of coupling portions, in the coupling portions, the first fabric layer and the second fabric layer pass through each other repeatedly and the first warps and the second warps are interlaced, the first warps, the first wefts, the second warps, and the second wefts are between 20 denier and 75 denier, the warp densities of the first fabric layer and the second fabric layer are between 336 pieces/in and 456 pieces/in, and the weft densities of the first fabric layer and the second fabric layer are between 220 pieces/in and 300 pieces/in.

2. The down-proof double-layer fabric of claim 1, wherein the first warps, the first wefts, the second warps, and the second wefts are between 30 denier and 50 denier.

3. The down-proof double-layer fabric of claim 1, wherein the materials of the first warps, the first wefts, the second warps, and the second wefts are polyester fibers, nylon fibers, cationic dyeable fibers, or cotton fibers.

4. The down-proof double-layer fabric of claim 1, wherein the material of the first warps differs from that of the second warps.

5. The down-proof double-layer fabric of claim 1, wherein the first warps, the first wefts, the second warps, and the second wefts are elastic yarn.

6. The down-proof double-layer fabric of claim 1, wherein the first warps and the second warps have different colors.

7. The down-proof double-layer fabric of claim 1, wherein the first fabric layer and the second fabric layer form a receiving space between two adjacent coupling portions.

8. The down-proof double-layer fabric of claim 1, further treated by surface calendaring at a temperature, wherein the temperature is between 50° C. and 70° C.

9. A down-proof double-layer fabric, comprising:

a first fabric layer, having a plurality of first warps and a plurality of first wefts; and a second fabric layer, having a plurality of second warps and a plurality of second wefts;

wherein the first fabric layer and the second fabric layer have a plurality of coupling portions, in the coupling portions, the first fabric layer and the second fabric layer pass through each other repeatedly and the first wefts and the second wefts are interlaced, the first warps, the first wefts, the second warps, and the second wefts are between 20 denier and 75 denier, the warp densities of the first fabric layer and the second fabric layer are between 336 pieces/in and 456 pieces/in, and the weft densities of the first fabric layer and the second fabric layer are between 220 pieces/in and 300 pieces/in.

* * * * *